United States Patent [19]

Lowry

[11] 4,098,463

[45] Jul. 4, 1978

[54] TEMPERATURE-CONTROLLED COMMINUTING METHOD AND APPARATUS

[75] Inventor: George W. Lowry, Fremont, Ind.

[73] Assignee: Metals & Plastics, Inc., Ashley-Hudson, Ind.

[21] Appl. No.: 765,421

[22] Filed: Feb. 3, 1977

[51] Int. Cl.[2] ..... B02C 23/18

[52] U.S. Cl. ..... 241/17; 241/23; 241/65

[58] Field of Search ..... 241/15, 17, 23, 20, 241/33, 38, 65, 242, 243

[56] References Cited

U.S. PATENT DOCUMENTS

| | | | |
|---|---|---|---|
| 1,762,241 | 6/1930 | Pontoppidan | 241/15 |
| 2,565,420 | 8/1951 | Ayers | 241/15 |
| 3,545,686 | 12/1970 | Brown | 241/243 |
| 3,815,833 | 6/1974 | Vliet et al. | 241/15 |
| 4,000,860 | 1/1977 | Gotham | 241/242 |
| 4,015,782 | 4/1977 | Granite | 241/243 |

*Primary Examiner*—Granville Y. Custer, Jr.

*Attorney, Agent, or Firm*—Fitch, Even, Tabin & Luedeka

[57] ABSTRACT

In a system for comminuting materials containing thermoplastics, the temperature in the comminuting chamber is monitored and a spray of cooling liquid is charged into the cutting chamber when the cutting chamber is at a temperature greater than the boiling temperature of the cooling liquid and less than the melting temperature for the thermoplastic being comminuted. By using heat of vaporization to extract heat from the cutting chamber, the likelihood of the plastic softening and/or melting and clogging the comminuting screen is substantially reduced. A higher throughput of materials is obtained because of material remaining harder. By vaporizing the liquid, the discharged comminuted material may be maintained very dry for later classifying. Preferably, the cooling liquid is discharged intermittently to keep the temperature of the comminuting chamber within predetermined upper and lower temperature limits. The illustrated comminuter comminutes scrap wire and also plastic materials such as vinyl plastic derived from the scrap wire.

6 Claims, 3 Drawing Figures

15
17
19
21
23
25
27
29
31
33
35
39
41
43
45
47
49
51
53
55
57
59
61
63
65
67
69
71
73
75
77
79
81
83
85
87
88
93
95
97
99
101
103
11
13

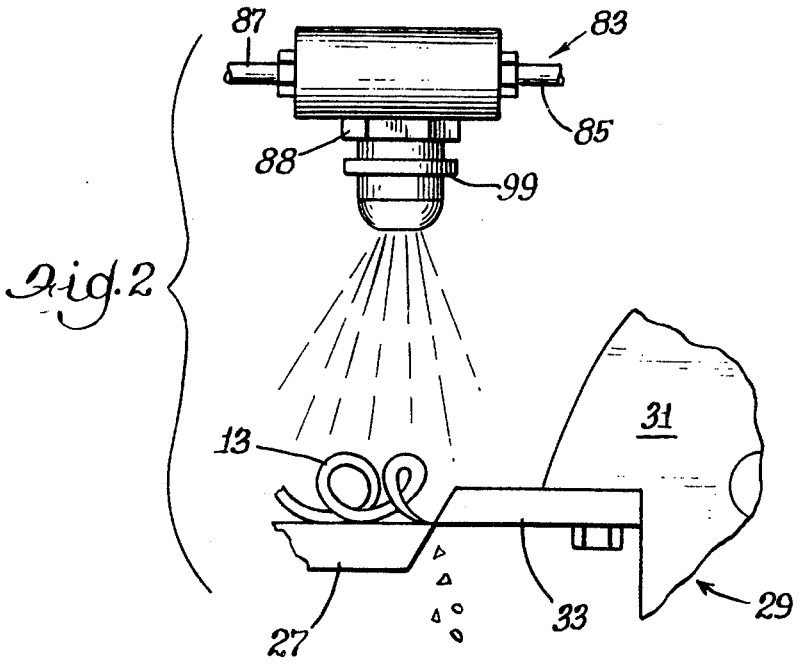
Fig. 2
Fig. 3.
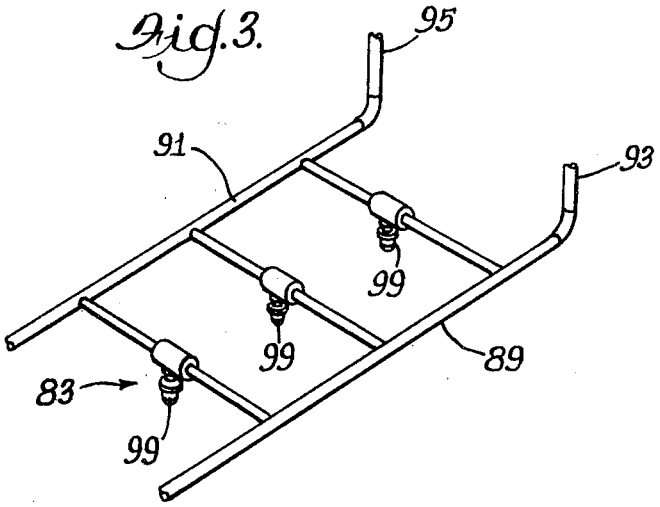

TEMPERATURE-CONTROLLED COMMINUTING METHOD AND APPARATUS

The present invention relates generally to systems for the recovery of scrap materials and more particularly to the comminuting systems for use in such recovery.

Various systems have been developed for the recovery of plastics and metals from scrap which includes mixtures of such materials, for example, the recovery of metal and plastic from insulated wires and cables.

In the usual process, the first step after sorting is passage of the scrap material through a comminuter where the material is reduced into small particles. This reduction is usually accomplished by the mechanical action of a pair of adjacent cutting elements which move relative to one another to sever the scrap into incremental amounts. Thereafter, the different materials (various plastics, metals, etc.) are separated by a variety of operations based upon differences in density and other characteristics such as disclosed in copending application Ser. No. 694,096 filed June 9, 1976.

The action of the relatively moving cutting elements necessarily creates heat. In a commercial operation, where large amounts of material are handled, the size reduction is usually accomplished between a stationary blade and a plurality of blades which are carried on a rotor which operates at high speed. A natural result of the continual cutting is that the heat created tends to accumulate in the moving elements and in their supporting elements. This heat is transferred to the scrap material as it is fed through the apparatus and cut.

The plastics most frequently encountered in recycled wire are polyethelene and polyvinyl chloride, both of which are thermoplastic and have melting points in the neighborhood of 150° C. The heat developed in typical comminuters can easily raise the temperature of the equipment to levels at which these plastics melt, or at least become quite soft. This softening has several detrimental effects. For example, the efficiency of the power source for driving the cutting elements is reduced significantly because more energy is required to cut a yielding material than is required to cut a brittle material. Also, in several reclaiming systems the comminuted particles are dropped onto screens to separate various sizes of the particles. If the plastic has softened substantially, the particles adhere to the screen, thus clogging the screen and lessening the productive capacity of the equipment.

A further deleterious effect is that other materials in the wire, e.g. metal and fibrous insulation, become embedded in the softened plastic, thus making separation more difficult. Telephone cord, a material frequently reclaimed, is particularly troublesome in this respect because fine nylon fibers are included within the cord and a polyvinyl chloride layer forms the outer insulation. The nylon fibers must be separated from the polyvinyl chloride in order to produce relaimed polyvinyl chloride of marketable purity. However, the nylon, along with the conducting metals, embeds itself in the softened polyvinyl chloride, significantly increasing the difficulty of separation.

Attempts have been made to prevent the softening of the plastic by providing a series of cooling conduits in the housing and various other portions of the comminuter. Chilled water is passed through these conduits in an effort to draw off the heat developed at the point of cutting. This system has not proven entirely satisfactory. Therefore, in order to maintain the temperature at an acceptable level, even though cooling coils are employed, the heat production itself is usually limited by reducing the rate of comminution In addition, unless one has an inexpensive source of water, such as a stream or well, such a system is expensive. These limitations are particularly undesirable in the field of recycling in which the economics are such that most systems are usually only marginally feasible.

It is, therefore, an object of the present invention to provide a method and apparatus for controlling the temperature of scrap material in a comminuter. It is also an object to provide a method and apparatus which increases the efficiency and productive capacity of comminuter power sources. Other objects and advantages of the invention will be apparent from the following description, including the drawings in which:

FIG. 2 is a diagrammatic view of the spraying section of the cooling system shown in FIG. 1.

FIG. 3 is a diagrammatic view of a nozzle shown in FIG. 2 as it dispenses atomized liquid.

Figure 1:
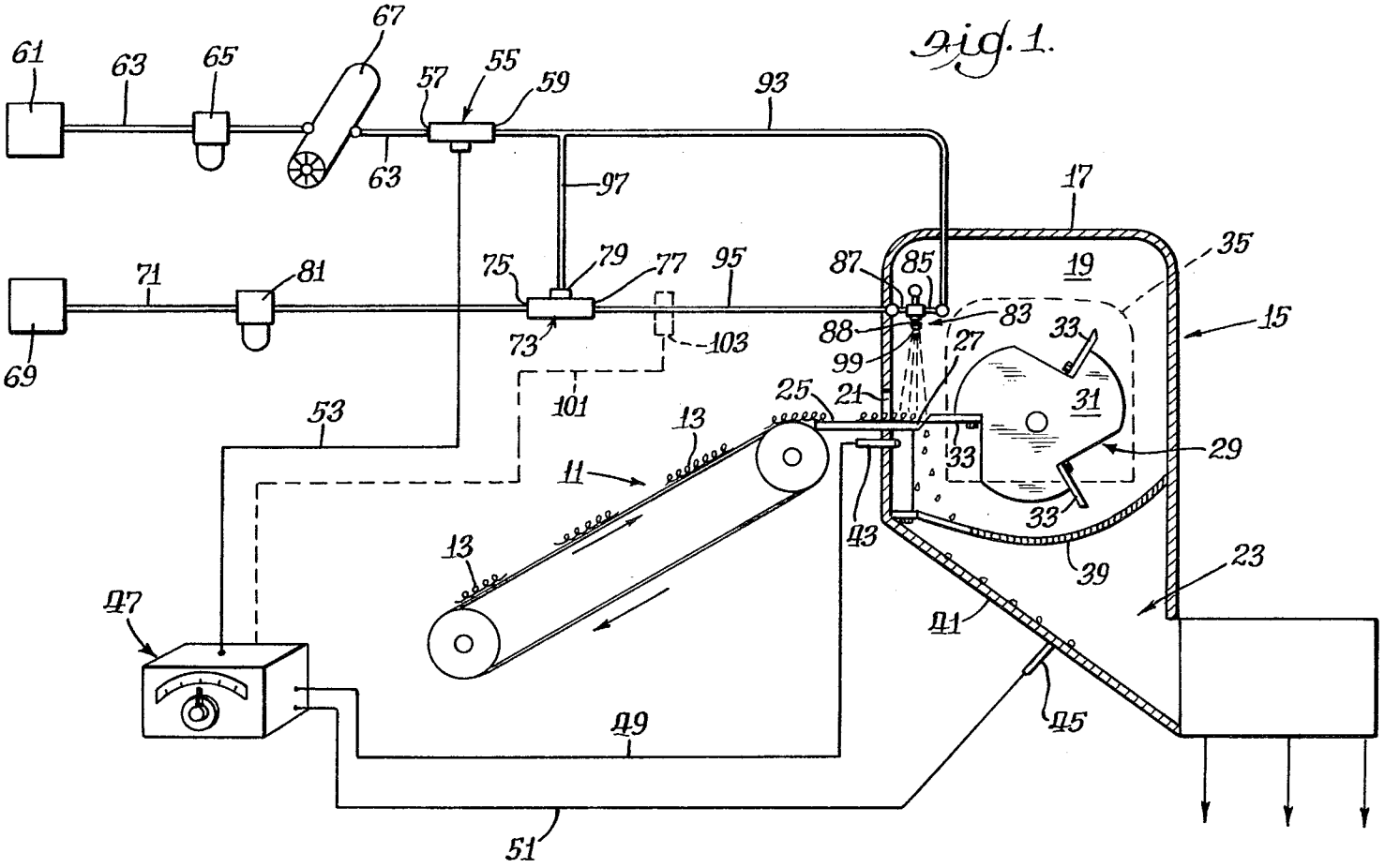
FIG. 1 is a diagrammatic view, partly in section, of a comminuter and cooling system embodying various features of the invention.

As disclosed herein, dry scrap material, containing plastics, is maintained within a particular temperature range during comminution to yield dry comminuted scrap material. In the disclosed method, dry scrap material, for example telephone cord, is subjected to the action of a plurality of co-acting relatively moving elements to cut it into small particles. The scrap material is fed to the cutting area at a rate which determines the size of the particles.

The particles are propelled by gravity, and the moving elements, onto a sizing screen which retains only those particles having dimensions greater than the limitations imposed by the separation steps which follow. Those particles falling through the screen openings strike a collecting wall which directs the particles to further processing. Oversized particles retained on the screen are recycled through the cutting elements. As will be pointed out, this can be accomplished by providing a stationary cutting element and a rotatable element having blades whose cylindrical path corresponds to the surface of the screen. Thus, particles which are retained on the screen are propelled by the blades back to the cutting area.

In the illustrated system, the temperature of at least one of the cutting elements is continuously monitored by a sensor located in a position providing thermal communication with the portion of the element which contacts scrap material during severance. This sensor communicates these temperature measurements to a controller which is programmed to react in response to a signal that a particular temperature limit has been exceeded. The temperature limit is determined by a number of factors, the first of which is the lowest melting temperature of the particular materials being cut. It is desired that the temperature at the point of cutting be as far below the lowest melting temperature as possible in order to keep the materials as firm as possible.

A second factor is the boiling temperature of the liquid used in the cooling spray. The illustrated system utilizes the latent heat developed by friction to vaporize a liquid applied to the surfaces of the cutting elements and the supplied material. Vaporization consumes significantly more heat than does merely raising the temperature of a liquid. For example, about one calorie is required to raise the temperature of one gram of water by one degree Centigrade. On the other hand, about 540 calories are required to vaporize one gram of water. Therefore, in order to extract a maximum amount of heat the maximum temperature is set above the boiling temperature of the sprayed liquid.

The sprayed liquid is selected with special attention paid to providing a low boiling temperature. However, expense is a necessary concern in reclamation systems. Because water is the most economical liquid, and the vapor thereof is relatively harmless (thus obviating a closed system), it is the liquid which will be used in most situations. Therefore, although the invention is not limited to the use of water as the sprayed liquid, it will be used herein by way of example.

As mentioned previously, it is desired that particles leaving the comminuter be dry enough so that they can be separated into the components desired without being subjected to an additional drying step. Therefore, substantially all of the liquid sprayed onto the material should be vaporized by the time the particles are discharged from the system. The temperature measured at the point of comminution is preferably maintained low enough to minimize softening of the plastic, but far enough above the boiling point of the cooling liquid to insure that severed material is at a sufficiently high temperature to varporize associated cooling liquid before it is discharged from the system. For example, in the comminution of scrap telephone cord containing polyethylene, which softens at around 150° C, the temperature at the point of comminution can be maintained at about 107° C when water is the cooling liquid. When this temperature is exceeded at the point of comminution, a spray of water is applied in the area of comminution and the immediately surrounding region, which includes the moving elements and scrap material approaching the comminution point. When the sensed temperature at the comminution point drops below the 107° C, the water spray is turned off.

It is preferred that the liquid sprayed into the region of comminution be finely divided and is preferably an atomized spray produced by a nozzle using pressurized air and liquid. In this manner, a minimal amount of liquid is applied, yet there is a maximum amount of surface contact providing for rapid evaporation and cooling.

In the preferred practice of the method, a second temperature sensor is employed. The second sensor is located in a position which provides continuous thermal communication with severed particles prior to the time when they exit from the comminuter, e.g., while they are carried by the collecting wall. The second sensor continuously communicates temperature levels to a controller which reduces the volume of the liquid or turns off the liquid spray.

The temperature level at the second sensor is maintained sufficiently high to insure that substantially all of the liquid is evaporated from the exiting particles. For example, where water is used as a cooling liquid, the minimum temperature is maintained over about the boiling temperature of water. Whenever the controller receives a signal from the second sensor that the temperature is less than the desired minimum temperature, the controller reduces the volume of the liquid or stops the spray.

To insure that no liquid is applied unless there is sufficient latent heat in the comminuted material to evaporate the liquid, a signal from the second sensor overrides a signal from the first sensor.

When a system, such as that shown in the drawings, is used, scrap material is inspected to ascertain the included material and attendant melting temperatures. Suitable temperature limits are selected (based upon the cooling liquid and lowest melting material of the thermoplastic material) and the temperature controller is set so that the cooling liquid is sprayed whenever a predetermined temperature limit is reached in the region of the scrap material and the cutting elements and the spray is reduced or turned off whenever the temperature of material passing through the screen before discharge from the comminuter falls below a predetermined level.

To summarize, the inspected scrap material is continually fed to the cutting elements, the action of which raises the temperature of the elements and, thus, through heat transfer, the temperature of the scrap material, the severed particles, and the other elements of the comminuter. The sensors monitor a temperature representative of temperature within the cutting chamber. When the monitored temperature for the cutting chamber reaches the preset temperature limit, as sensed by the first sensor and measured by the controller, the controller actuates the spray nozzle to discharge a mist of atomized liquid into the comminuting region. The nozzles are directed towards the point of severance, so that the mist spreads and vaporizes at the location of greatest heat generation, i.e., at the cutting location. Because of the elevated temperatures in the cutting chamber, the atomized liquid is readily vaporized so that the material and apparatus remain dry when being cut and discharged, yet substantial amounts of liquid are atomized and injected into the cutting chamber.

Preferably, a second sensor is provided which monitors the severed material which passes through the screen and when the temperature sensed by the second sensor drops below the temperature limit set for severed particles, the controller reduces the volume of the liquid or turns off the spray to insure that the particles discharged from the comminuter are dry enough for proper separation in subsequent processing.

Referring to the drawings, the illustrated comminuter system includes advancing means 11 for continually supplying sorted scrap material 13 to a comminuter 15. The comminuter 15 includes a housing 17 defining a chamber 19, the housing having an entrance opening 21 and a discharge opening 23. Attached to the housing 17 in the chamber 19 adjacent the entrance opening 21 is a support platform 25 which includes a stationary cutting element 27 at its innermost edge. Rotatably mounted within the chamber 19 is a rotating cutting element 29 which comprises an elongated rotor 31 (shown in cross section in FIG. 1) which carries a plurality of elongated blades 33 which are arranged substantially parallel to the axis of rotation of the rotor. A suitable power source, such as the motor 35, drives the rotor 31 by means of the belts. In order to assure that the scrap material is reduced to the proper size a screen 39 having openings of a predetermined size, is supported in the chamber 19. The screen 39 is formed in an arcuate shape, as illustrated, the shape being such that it approximates the path of the tips of the blades 33 as they rotate with the rotor 31. In order that the material which passes through the screen 39 is discharged from the discharge opening 23, the housing 17 is provided with a lower wall 41 (the collecting wall) which underlies the screen 39 and which slopes to the discharge opening 23.

In order to sense the temperature of scrap material at the point of cutting and the temperature of the cutting elements, a first temperature sensor 43 is provided in a position allowing thermal communication indicative of the temperature within cutting chamber 19. The sensor 43 may comprise any standard temperature sensor, but a thermocouple has been found to be satisfactory. As illustrated, the sensor 43 is preferably mounted adjacent to the stationary element 27. It has been found that a position about one inch from its cutting edge supplies satisfactory measurements.

In order to sense the temperature of scrap particles prior to discharge from the system, a second temperature sensor 45 is provided in a position allowing thermal communication with the severed material. The sensor 45 may comprise any standard temperature sensor but a thermocouple has been found to be satisfactory. As illustrated, the sensor 45 is mounted in the lower wall 41 below its inner surface.

The sensors 43 and 45 are each connected to a temperature control means 47 by means of cables 49 and 51, respectively.

The temperature control means 47 comprises a standard, commercially available temperature controller capable of opening a valve in response to detection of a preset temperature limit by the sensor 43 and closing the valve in response to detection of a preset particle temperature limit by the sensor 45. A suitable controller is manufactured by Love Controls Corporation in Wheeling, Ill. and is designated Model 49 Proportioning Controller. Preferable, the communicated temperatures are calibrated to compensate for the variances due to the imperfect thermal conductivity of the platform and the collecting wall because the primary concerns are for the temperature at the point of comminution and the temperature of the severed particles.

As pointed out above, the cooling can be accomplished by means of a spray of liquid, however, best results are obtained when the spray is composed of fine particles which are readily dispersed in the chamber and on the materials being comminuted. This insures that the cooling is relatively uniform and that accumulations of excess cooling liquid are avoided. To this end, the cooling liquid in the illustrated embodiment is atomized by pressurized air.

Connected to the control means 47 through a cable 53 is a normally closed solenoid air valve 55 having an inlet 57 and an outlet 59. Pressurized air is supplied from an air source 61 through a conduit 63 to the inlet 57 of the air valve 55. A suitable filter 65 to protect the system from foreign material and an air regulator 67 to control air pressure are provided in the conduit 63. Pressurized liquid, e.g., water, intended for use in the cooling spray is supplied from a liquid source 69 through conduit 71 to a normally closed, air-actuated liquid valve 73, having a liquid inlet 75, a liquid outlet 77 and a control air inlet 79. A suitable filter 81 is provided in the conduit 71 to protect the system from foreign material.

Mounted in the housing 17 are nozzle means 83 having an air inlet 85, a liquid inlet 87 and a spray outlet 88 which is directed towards the point of cutting so that the cooling is taking place at the location where the highest temperatures are being generated. In order to supply air and liquid to the nozzle means 83 an air manifold 89 and a liquid manifold 91 are provided, each being connected to the respective air inlet 85 and liquid inlet 87 of the nozzle means 83. A conduit 93 connects the air valve 55 to the air manifold 89, a conduit 95 connects the liquid valve 73 to the liquid manifold 91, and a conduit 97 connects the conduit 93 to the control air inlet 79 of the air-actuated liquid valve 73.

As shown in FIG. 3, the nozzle means 83 preferably comprises a plurality of nozzles 99 which are spaced apart and located above and along the length of the stationary blade 27. The preferred arrangement of the nozzles 99 provides that the mist of cooling liquid is superimposed over the entire length of the cutting elements 27 and 29. Herein, the nozzles 99 are spaced to allow a slight overlap in their spray patterns at the point of cutting, assuring that the entire lengths of the cutting elements 27 and 29 are cooled and preferably are adjusted to provide an oval pattern to minimize variations in concentration of the cooling liquid. In addition, the rotary action of the cutting element 29 and the small size of the chamber assures that cooling effect is not totally localized at the locations of the vaporization.

In operation, when the sensor 43 senses a temperature which exceeds the preset temperature limit for desired temperature for the cutting chamber 19 and that information is relayed to the controller 47, the controller actuates the air valve 55, permitting pressurized air to flow through conduit 93 to the air manifold 89. In addition, a portion of the air flowing through conduit 93 flows through the conduit 97 and opens the liquid valve 73. Opening the liquid valve 73 allows pressurized liquid to flow from the liquid source 69 through conduits 71 and 95 to the liquid manifold 91. The air and liquid supplied to their respective manifolds then flow to the inlets 85 and 87, respectively, of the nozzles 99.

The nozzles 99 mix and discharge the air and liquid as a spray or mist. The spray discharged is preferably finely divided and directed and shaped so spray is vaporized adjacent the cutting elements 27 and 29 at the point of cutting, as shown in FIG. 2. The nozzles used are standard adjustable nozzles, such as those available from Spraying Systems Co., Bellwood, Ill., under the designation Spray Set-Up No. 22.

When the sensor 45 senses a temperature which is less than the preset temperature limit for particles discharged from the system and that information is relayed to the controller 47, the controller de-actuates the air valve, thus turning off the spray.

To obtain finer control, the signal from the sensor 45 may be employed in two steps. As shown in dotted outline the controller 47 can be connected by means of a cable 101 to a throttling valve 103 in liquid conduit 45 so that the volume of liquid passing through conduit 95 is first reduced as the temperature approaches the predetermined maximum temperature and, finally when it does reach the predetermined maximum, the valve 73 closes off the liquid supply.

In situations in which the amount of supplied scrap material is known and is substantially constant over time, a satisfactory system can employ only one sensor, the sensor 43. Through proper adjustment of the nozzle means 83, the appropriate amount of cooling liquid is applied: enough to cool the material to a satisfactory temperature, yet leave no excess liquid to be discharged from the system with the particles.

In one commercial operation employing the system described herein, a dry scrap telephone cord, comprising an outer jacket of polyvinyl chloride surrounding a copper ribbon wrapped around a core of nylon fibers, was fed into the comminuter, a Model 48 Super Granulator sold by Triple/S Dynamics Engineers, Inc., Dallas Tex. The comminuter included a stationary blade and a rotating core carrying three longitudinal blades. The core was rotated by two 250 horsepower motors through conventional mechanism at a rate of 1,050 rpm. Atomized water was applied to the material and blades at a rate of 8 gallons per hour and the temperature controller was set to initiate spraying in response to a signal that the temperature of the stationary element exceeded 107° C. Spraying was stopped when the temperature of particles at the collecting wall fell below 100° C. The discharge from the system feels substantially bone dry, even though steam-like vapor can be seen issuing from the inlet opening to the cutting chamber.

The invention is of particular utility in preventing softening and melting down of plastic materials being chopped into very fine pieces after having been initially separated from a wire. In this operation, the predominantly vinyl mixture of plastic is to be size reduced substantially in order to pass through a fine screen. In the absence of the cooling provided by the present invention, the throughput must be reduced to about one-fourth of that achieved with cooling of the present invention. That is, without the dissipation of heat, the plastic softens and clogs the screens and eventually closes the screen openings causing a shutdown of the comminuter and a costly and time-consuming screen replacement.

Another application of the invention is to cool a comminuter which is chopping middlings or other copper pieces from which the plastic was not liberated at the first comminuting of the scrap wire, as has been described above. Such a comminuter also uses a fine screen which can be readily clogged by plastic when it has been allowed to soften sufficiently.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed is:

1. In a process for reclaiming plastic insulation from scrap wire having an internal metal conductor and a core of nylon fibers, said process comprising the steps of:

comminuting the scrap wire in a cutting chamber;

separating the plastic pieces from the metal and the nylon fibers;

the improvement for reducing the amount of plastic pieces with nylon fiber embedded therein comprising during comminuting sensing a temperature indicative of the temperature in the cutting chamber and of the temperature of plastic insulation pieces, limiting the temperature in the cutting chamber to a temperature to maintain said plastic insulation hard to resist embedding of nylon fibers therein by discharging a spray of cooling liquid into said cutting chamber in response to said sensed temperature which exceeds a predetermined temperature, and controlling the temperature of the discharging pieces such that the cooling liquid will evaporate to provide substantially dry particles for separation with a minimal amount of pieces of plastic embedded with nylon.

2. A process in accordance with claim 1 in which vinyl plastic and polyethylene plastic pieces are in said scrap wire and in which said predetermined temperature at which said plastic softens is in excess of about 107° C and in which the water spraying is reduced when the temperature of particles leaving is less than about 100° C.

3. A process in accordance with claim 1 including a further step of sensing a temperature indicative of temperature of the pieces being discharged and operating a throttling valve to reduce the amount of cooling liquid to prevent wet pieces from being discharged from the comminuter.

4. A comminuter apparatus for comminuting pieces of scrap wire into pieces of plastic, wire, plastic embedded with nylon filler, and plastic with embedded metal for reclamation of the plastic comprising, a housing having an inlet and a discharge opening, a stationary cutting element mounted in said housing, a rotating cutting element mounted in said housing and having a blade which coacts with the stationary cutting element to sever the scrap wire, a screen having openings of a predetermined size covering said discharge opening to assure that the particles have a predetermined size in at least one direction in order to pass through said screen and into said discharge opening, said rotating blade carrying particles which do not pass through said screen around for further cutting, liquid spraying means for spraying liquid into said housing for evaporation therein to cool the plastic before the same softens and embeds therein more easily nylon fibers and pieces of metal or clogs the openings in said screen, temperature sensor means in thermal communication with the housing to sense temperatures of the plastic in the housing and temperatures indicative of the pieces leaving said comminuter so that the cooling liquid will evaporate and dry particles will be discharged, and control means connected to said temperature sensing means and to said liquid spraying means to maintain the temperature below that at which the plastic particles soften and above a temperature at which the liquid will evaporate from the pieces to assure dry pieces for separation after the discharge thereof from said comminuter.

5. A comminuter apparatus in accordance with claim 4 in which said temperature sensor means comprises a first thermocouple for sensing the temperature inside of said cutting chamber and a second temperature sensor means for sensing the discharge temperature of the particles having passed through said screen.

6. A comminuter apparatus in accordance with claim 4 in which a throttle valve means is provided in said liquid spraying means and in which said controller means controls said throttle valve to reduce the liquid flow therethrough as the temperature sensing means senses the temperature approaching a predetermined temperature.

* * * * *